US009341172B2

(12) United States Patent
Kohli et al.

(10) Patent No.: US 9,341,172 B2
(45) Date of Patent: May 17, 2016

(54) POSITIVE DISPLACEMENT PUMP

(71) Applicant: KNF Flodos AG, Sursee (CH)

(72) Inventors: Daniel Kohli, Aarau (CH); Stephan Kaufmann, Gunzwil (CH)

(73) Assignee: KNF Flodos AG, Sursee (CH)

( * ) Notice: Subject to any disclaimer, the term of this patent is extended or adjusted under 35 U.S.C. 154(b) by 540 days.

(21) Appl. No.: 13/742,623

(22) Filed: Jan. 16, 2013

(65) Prior Publication Data

US 2013/0183173 A1 Jul. 18, 2013

(30) Foreign Application Priority Data

Jan. 17, 2012 (DE) ..... 10 2012 000 676

(51) Int. Cl.

| | |
|---|---|
| ***F04B 35/04*** | (2006.01) |
| ***F04B 17/03*** | (2006.01) |
| ***F04B 43/02*** | (2006.01) |
| ***F04B 43/04*** | (2006.01) |

(52) U.S. Cl.

CPC ..... *F04B 17/03* (2013.01); *F04B 35/045* (2013.01); *F04B 43/02* (2013.01); *F04B 43/04* (2013.01)

(58) Field of Classification Search

CPC ..... F04B 17/04; F04B 17/042; F04B 17/044; F04B 35/045; F04B 43/04; F04B 45/047

USPC ..... 417/413.1, 417

See application file for complete search history.

(56) References Cited

U.S. PATENT DOCUMENTS

| | | | | | |
|---|---|---|---|---|---|
| 4,299,544 | A | * | 11/1981 | Masaka | F04B 17/046 417/417 |
| 4,306,843 | A | * | 12/1981 | Arai | F04B 17/046 417/417 |
| 4,778,357 | A | * | 10/1988 | Arai | F04B 17/046 417/417 |
| 4,826,130 | A | * | 5/1989 | Griffith et al. | 251/129.15 |
| 5,188,073 | A | * | 2/1993 | Ejiri et al. | 123/339.28 |
| 5,330,153 | A | * | 7/1994 | Reiter | 251/129.21 |
| 5,503,174 | A | * | 4/1996 | Schulze | 137/1 |
| 2007/0236089 | A1 | * | 10/2007 | Okubo | 310/30 |
| 2010/0196176 | A1 | * | 8/2010 | Kaufmann et al. | 417/413.1 |

FOREIGN PATENT DOCUMENTS

| | | |
|---|---|---|
| DE | 2410768 | 5/1978 |
| DE | 3035780 | 6/1984 |
| DE | 4003229 | 8/1991 |
| DE | 19900995 | 8/1999 |
| DE | 102007030311 | 1/2009 |

* cited by examiner

*Primary Examiner* — Charles Freay

(74) *Attorney, Agent, or Firm* — Volpe and Koenig, P.C.

(57) ABSTRACT

A positive displacement pump (1) with a pump head (3), in which (3) at least one pump space (6) is provided, with a pump diaphragm (7), which is associated with the at least one pump space (6) and which (7) separates the pump space (6) from a reciprocating drive.

16 Claims, 3 Drawing Sheets

POSITIVE DISPLACEMENT PUMP

INCORPORATION BY REFERENCE

The following documents are incorporated herein by reference as if fully set forth: German Patent Application No. 102012000676.4, filed Jan. 17, 2012.

BACKGROUND

The invention relates to a positive displacement pump, in particular a reciprocating-armature or solenoid positive displacement pump, with a pump head, in which at least one pump space is provided, with a pump diaphragm, which is associated with the at least one pump space and which separates the pump space from a reciprocating drive, and with a reciprocating drive, which has a magnetic armature, which is guided movably in the longitudinal direction and which acts on a flat side of the pump diaphragm which is remote from the pump space and which can be caused to perform an intake stroke electromagnetically counter to a restoring force by means of a coil.

Positive displacement pumps of the type mentioned at the outset configured as reciprocating-armature pumps which have a pump head, in which at least one pump space is provided which can have a spherical dome shape, for example, are already known. A pump diaphragm which separates the pump space from a reciprocating drive is associated with the at least one pump space. The reciprocating drive has a magnetic armature, which is guided in the longitudinal direction and which acts on that flat side of the diaphragm which is remote from the pump space and can be caused to perform an intake stroke counter to a restoring force by means of an electromagnet.

If the abovementioned reciprocating-armature pump is operating in the delivery mode, a compression spring has the task of implementing the pressure stroke. The intake stroke is implemented by the force which is built up in the magnetic circuit by the coil of the electromagnet. It is critical here that the magnetic circuit built up by the electromagnet is guided as optimally as possible through the magnetically conductive components of the pump and is transferred to the magnetic armature imparting the pump movement.

SUMMARY

Therefore, the object is in particular to provide a positive displacement pump of the type mentioned at the outset which is characterized by an optimized magnetic circuit and thus by a particular capacity with high efficiency.

This object is achieved according to the invention in the case of the pump of the type mentioned at the outset in particular in that the coil interacts with a magnetic return path element, in that the magnetic armature is guided movably in a guide sleeve, which passes through through-openings provided in sides of the magnetic return path element that are remote from one another, in that a section of the guide sleeve that is formed by a conducting sleeve passes through the through-opening closer to the pump space, and a section of the guide sleeve that is formed by a stator passes through the through-opening remote from the pump space, and in that the conducting sleeve and the stator, which are produced from magnetically conductive material, are magnetically isolated by a section of the guide sleeve that is formed by an insulator sleeve formed of magnetically nonconductive material.

In the positive displacement pump according to the invention, a coil of the electromagnet interacts with a magnetically conductive magnetic return path element. This magnetic return path element has through-openings which are aligned with one another in those sides of the magnetic return path element that are remote from one another, with a guide sleeve passing through said through-openings, and the magnetic armature being guided moveably in said guide sleeve. While a section of the guide sleeve that is formed by a conducting sleeve is passed through the through-opening closer to the pump space, a section of the guide sleeve that is formed by a stator is provided in the through-opening that is remote from the pump space. The conducting sleeve and the stator are produced from magnetically conductive material and are separated magnetically from one another by a section of the guide sleeve that is formed by an insulator sleeve.

Since the intake stroke of the positive displacement pump according to the invention is implemented by the force which is built up in the magnetic circuit by the coil, it is critical that this magnetic circuit is guided as optimally as possible through the magnetically conductive components of the pump, namely through the magnetic return path element, the conducting sleeve, the stator and the magnetic armature. In this case, it is critical that only parasitic air gaps which are as small as possible arise between the individual components, in addition to the working air gap between the stator and the magnetic armature, because these parasitic air gaps very significantly impede the magnetic flux. In the case of the positive displacement pump according to the invention, these air gaps are reduced with the aid of the guide sleeve, which substantially consists of the conducting sleeve, the insulator sleeve and the stator, and the magnetic circuit is optimized, wherein, at the same time, effective guidance of the magnetic armature in the guide sleeve is also ensured. The magnetic flux is conducted from the magnetic return path element to the magnetic armature via the conducting sleeve. As soon as the coil is energized, a magnetic circuit is produced via the magnetic return path element, the conducting sleeve, the magnetic armature and the stator, which magnetic circuit moves the magnetic armature, which is connected to the diaphragm, in the direction towards the stator counter to the restoring force. When the coil is no longer energized, the magnetic armature and the diaphragm connected thereto is moved in the direction towards the pump space by the restoring force.

In order to be able to combine the guide sleeve, which consists substantially of the conducting sleeve, the insulator sleeve and the stator, to form one unit, it is expedient if the conducting sleeve, the insulator sleeve and the stator of the guide sleeve are welded, adhesively bonded, pressed, soldered or similarly connected to one another.

In order to be able to guide the magnetic armature effectively during the pump movements, it is advantageous if the magnetic armature is guided in that section of the guide sleeve which is formed by the insulator sleeve.

In order to conduct the magnetic flux from the magnetic return path element to the magnetic armature and in order to prevent at the same time direct contact between the conducting sleeve and the magnetic armature, it is advantageous if that section of the guide sleeve which is formed by the conducting sleeve encompasses the magnetic armature with clearance.

A particularly simple and at the same time efficient embodiment in accordance with the invention provides that at least one compression spring acts as the restoring force acting on the magnetic armature.

In this case it is advantageous if the at least one compression spring is supported on the conducting sleeve. While the compression spring is supported with one of its end regions on the conducting sleeve, the compression spring acts with its end region remote from the conducting sleeve on the magnetic armature in such a way that said magnetic armature is moved in the direction towards the pump space during the pressure stroke.

It is advantageous if the stator limits the intake stroke of the armature in the guide sleeve.

A particularly advantageous development in accordance with the invention provides that the stroke path of the at least one pump diaphragm is adjustable, and that the pump has a pump housing, in which the guide sleeve is arranged adjustably in the longitudinal direction for this purpose. By virtue of an adjusting movement on the guide sleeve in the direction remote from the pump space, the stroke length and with it the conveying power of the pump according to the invention can be increased, if required.

A preferred embodiment of the invention provides that the guide sleeve bears an outer thread, which meshes with an inner thread fixed in position relative to the pump housing, at least in one section of the outer circumference of said guide sleeve. By virtue of a screw movement on the guide sleeve, the stroke length can thus be increased or reduced to the desired extent.

It is particularly advantageous if the conducting sleeve has a sleeve head which is preferably configured as a cross-section expansion and which bears the outer thread, and the inner thread is provided on the pump housing and preferably on an intermediate plate of the pump housing.

In order to implement the sliding guidance of the magnetic armature in the guide sleeve in such a way that said guide sleeve allows as great a number of stroke movements as possible with as little friction as possible and therefore as much of the energy of the magnetic circuit (electrical drive energy) is converted into mechanical work (stroke times stroke force) which can be used for the pump function, it is expedient if the guide sleeve and in particular the insulator sleeve on the inner circumference side and/or the magnetic armature on the outer circumference side have/has a friction-reducing sliding layer. In this case, a preferred embodiment in accordance with the invention provides that this sliding layer is configured as a polymer layer, in particular as a polytetrafluoroethylene or molybdenum disulfide layer.

The magnetic return path element of the positive displacement pump according to the invention can be formed as a coil frame in the form of a U, for example. However, it is also possible for the magnetic return path element of the positive displacement pump according to the invention to be in the form of a magnetically conductive sleeve, which has the through-openings for the guide sleeve in those end sides of said magnetically conductive sleeve which are remote from one another.

BRIEF DESCRIPTION OF THE DRAWINGS

Developments in accordance with the invention result from the claims and the description relating to the drawing. The invention will be described in more detail below with reference to preferred exemplary embodiments.

In the drawing, illustrated schematically.

DETAILED DESCRIPTION OF THE PREFERRED EMBODIMENTS

Figure 1:
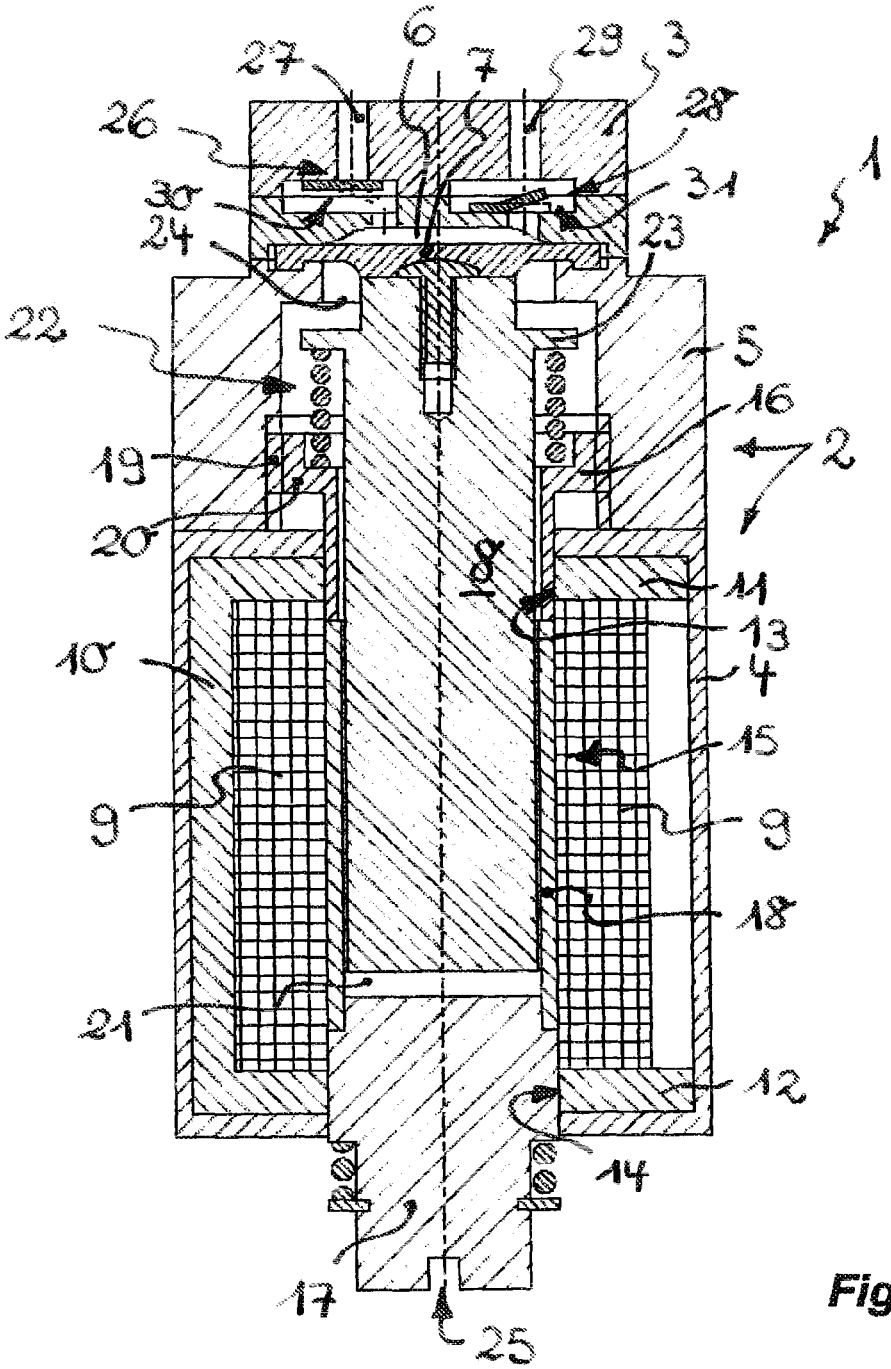
FIG. 1 shows a positive displacement pump configured as a solenoid positive displacement pump in a longitudinal section, which positive displacement pump has a magnetic return path element in the form of a coil frame, on which a guide sleeve is held, in which a magnetic armature is guided movably.
Figure 2:
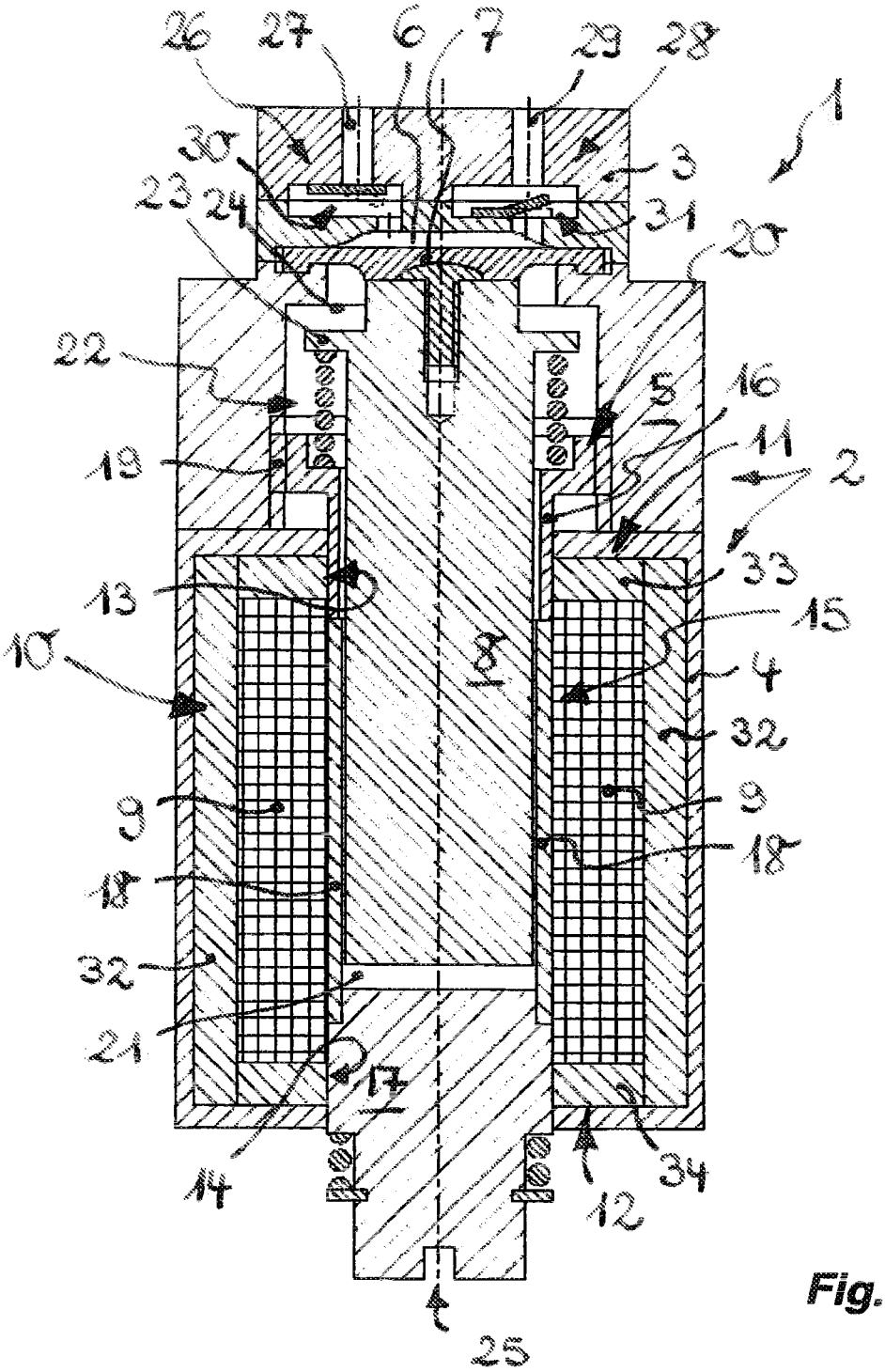
FIG. 2 shows a positive displacement pump with a comparable configuration to that in FIG. 1 and likewise shown in a longitudinal section, wherein the positive displacement pump depicted here has a magnetic return path element which is in the form of a magnetically conductive sleeve.

FIGS. 1 and 2 illustrate two embodiments of a positive displacement pump 1, which is configured as a solenoid positive displacement pump. The positive displacement pump 1 shown in FIGS. 1 and 2, which is preferably used as a liquid pump, has a pump housing 2, which has a pump head 3, a drive housing 4 and an intermediate plate 5 provided between the drive housing 4 and the pump head 3. A pump space 6 is provided in the pump head 3, which pump space 6 can be configured, for example, in the form of a spherical dome, as is the case here. The pump space 6 is connected to an intake channel 27 via at least one inlet 26 and to a pressure channel 29 via at least one outlet 28. While a nonreturn valve 30 located in the inlet 26 permits the intake of pumping medium in the direction towards the pump space 6, a nonreturn valve 31 provided in the outlet 28 prevents a return flow of the pumping medium back to the pump space 6.

A pump diaphragm 7 formed of elastic material is associated with the pump space 6, which pump diaphragm is clamped between the pump head 3 and the intermediate plate 5 and separates the pump space 6 from a reciprocating drive. The pump diaphragm 7 is in this case in the form of a molded diaphragm which has an outer contour which is approximately complementary to the pump space in its central region facing the pump space 6.

The reciprocating drive has a magnetic armature 8, which is guided movably in the longitudinal direction. The magnetic armature 8 acts on the pump diaphragm 7 on the flat side remote from the pump space 6. The magnetic armature 8 can be caused to perform an intake stroke electromagnetically counter to a restoring force by a coil 9. For this purpose, the coil 9 interacts with a magnetically conductive magnetic return path element 10. In this case, the coil 9 of the electromagnet is embraced by the magnetic return path element 10, which has through-openings 13, 14 which are aligned with one another in those sides 11, 12 of said magnetic return path element which are remote from one another. A guide sleeve 15 is passed through these through-openings 13, 14, with the magnetic armature 8 being guided moveably in said guide sleeve. In order to connect this guide sleeve 15 fixedly to the magnetic return path element 10, the guide sleeve 15 is pushed through the through-openings 13, 14. In this case, a section of the guide sleeve 15 that is formed by a conducting sleeve 16 is passed through the through-opening 13 closer to the pump space 6, and a section of the guide sleeve 15 that is formed by a stator 17 is passed through the through-opening 14 remote from the pump space 6. The conducting sleeve 16 and the stator 17, which are produced from magnetically conductive material and in particular from soft-magnetic material, are separated from one another magnetically by a section of the guide sleeve 15 that is formed by an insulator sleeve 18, which insulator sleeve 18 is produced from magnetically nonconductive material for this purpose. The constituents of the guide sleeve 15 which have different magnetic properties, namely the conducting sleeve 16, the insulator sleeve 18 and the stator 17, are in this case concentrically connected by means of an adhesive-bonding or a welding method, for example by laser welding.

The insulator sleeve 18 not only has to connect the conducting sleeve 16 and the stator 17 to one another and at the same time to prevent a direct magnetic return path, but also the magnetic armature 8, which performs the pump movement and transfers the pump movement to the pump diaphragm 7, is guided displaceably in the insulator sleeve 18.

Figure 3:
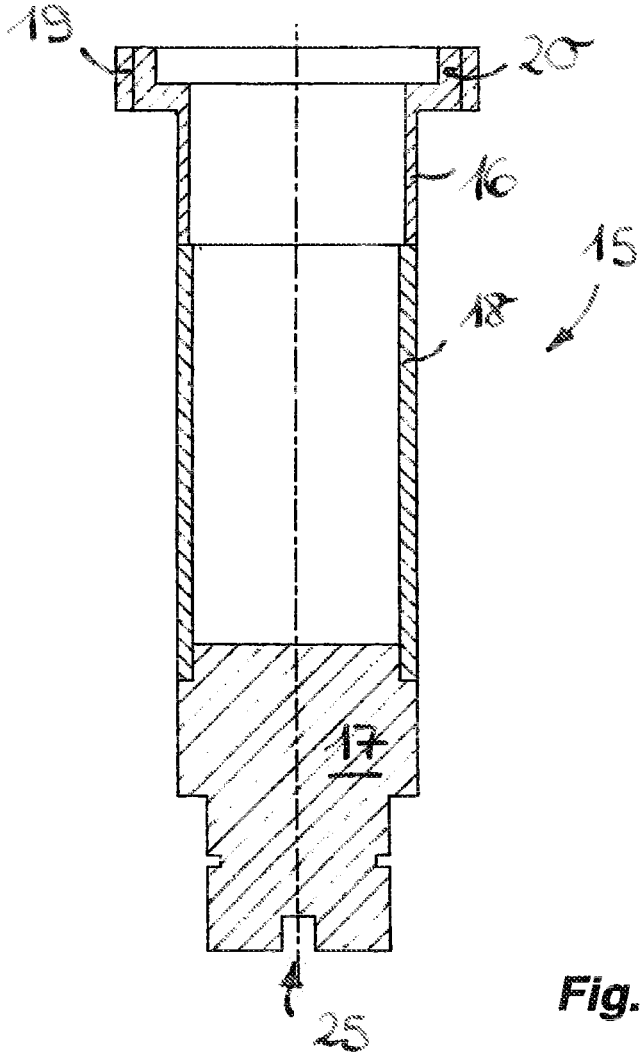
FIG. 3 shows the longitudinally sectioned guide sleeve of the positive displacement pump embodiments shown in FIGS. 1 and 2.

In contrast, the conducting sleeve 16 has a slightly larger clear inner diameter than the outer circumference of the magnetic armature 8, with the result that that section of the guide sleeve 15 (not illustrated in any more detail in FIG. 3) which is formed by the conducting sleeve 16 encompasses the magnetic armature 8 with play. The conducting sleeve 16 therefore does not guide the magnetic armature 8, but instead has the object of conducting the magnetic flux from the magnetic return path element 10 to the magnetic armature 8. The tolerances between the conducting sleeve 16 and the magnetic armature 8 are in this case selected such that as small an air gap as possible between the conducting sleeve 16 and the magnetic armature 8 is produced, but is also sufficient for preventing direct contact between the conducting sleeve 16 and the magnetic armature 8. If the conducting sleeve 16 were likewise to be produced from magnetically nonconductive material, the total material thickness of the conducting sleeve 16 would act as an air gap and the magnetic circuit would have a much lesser performance and be less efficient.

In the case of the positive displacement pump 1 illustrated here, the stroke path of the magnetic armature 8 and therefore also the pump capacity of the positive displacement pump 1 are adjustable. For this purpose, the guide sleeve 15 is arranged adjustably in the longitudinal direction in the pump housing 2. The guide sleeve 15 bears an outer thread 19, which meshes with an inner thread fixed in position relative to the pump housing 2, at least in one section of the outer circumference of said guide sleeve. In the pump embodiment illustrated here, the conducting sleeve 16 has a sleeve head 20, which is in this case configured as a cross-section expansion and bears the outer thread 19. The inner thread interacting with the outer thread 19 is provided on the pump housing 2 and preferably on the intermediate plate 5 of the pump housing 2. The position of the guide sleeve 15 in the pump housing 2 can be adjusted axially by virtue of the outer thread 19 provided on the guide sleeve 15. As a result, the distance between the magnetic armature 8 and the stator 17 can be adjusted. Depending on the position of the guide sleeve 15, the displacement volume which can be generated by the pump diaphragm 7 can be varied, if required. For this purpose, a tool intervention area is provided on the front end that is accessible from the outside and is remote from the pump space 6, which tool intervention area is in this case in the form of a slot 25 for the insertion of a screwdriver.

The intake stroke of the positive displacement pump 1 is performed by the force which is built up in the magnetic circuit by the coil 9. In order to guide the magnetic circuit during energization of the coil 9 as optimally as possible through the magnetically conducting components of the positive displacement pump 1, namely through the magnetic return path element 10, the conducting sleeve 16, the stator 17 and the magnetic armature 8, it is critical that parasitic air gaps which are as small as possible are produced between the individual components, in addition to the working air gap 21 remaining between the stator 17 and the magnetic armature 8, because these parasitic air gaps very significantly impede the magnetic flux. In the case of the positive displacement pump 1, these air gaps are reduced with the aid of the guide sleeve 15, which consists substantially of the conducting sleeve 16, the insulator sleeve 18 and the stator 17, and the magnetic circuit is optimized, wherein at the same time effective guidance of the magnetic armature 8 in the guide sleeve 15 is also ensured. The magnetic flux is conducted from the magnetic return path element 10 to the magnetic armature 8 via the conducting sleeve 16. As soon as the coil 9 is energized, a magnetic circuit is produced via the magnetic return path element 10, the conducting sleeve 16, the magnetic armature 8 and the stator 17, which magnetic circuit moves the magnetic armature 8, which is connected to the pump diaphragm 7, counter to the restoring force of a restoring spring 22 in the direction towards the stator 17. If the coil 9 is no longer energized, the magnetic armature 8 and the pump diaphragm 7 connected thereto are moved by the restoring spring 22 in the direction towards the pump space 6.

The compression spring 22 is supported on the conducting sleeve 16. For this purpose, the conducting sleeve 16 has a depression in its end side facing the pump space 6, with one end region of the compression spring 22, which encompasses the magnetic armature 8, being arranged in said depression. The magnetic armature 8 has a ring flange 23 in its end region facing the pump space 6, with that end region of the compression spring 22 which faces the pump space 6 bearing against or acting on said ring flange. In the de-energized state of the coil 9, the compression spring 22 presses the magnetic armature 8 into a diaphragm space 24 of the intermediate plate 5. As soon as the coil 9 is energized, a magnetic circuit is produced via the magnetic return path element 10, the conducting sleeve 16, the magnetic armature 8 and the stator 17. In the process, a force is built up in the case of the working air gap 21 between the magnetic armature 8 and the stator 17, which force exceeds the force of the compression spring 22 and can thus be used to draw the magnetic armature 8 onto the stator 17. Finally, for example, liquid can be drawn into the pump space 6 with the pump diaphragm 7 moving along with the magnetic armature 8, which liquid then, when the coil 9 is no longer energized, is expelled again by action of the compression spring 22.

The embodiments of the positive displacement pump 1 illustrated in FIGS. 1 and 2 differ merely in terms of the configuration of their magnetically conductive magnetic return path element 10. In this case, the magnetic return path element 10 of the positive displacement pump illustrated in FIG. 1 is in the form of a coil frame, which has an approximately U-shaped configuration and has the mutually aligned through-openings 13, 14 in its frame ends 11, 12, which act as sides that are remote from one another. In contrast, the magnetic return path element 10 of the positive displacement pump 1 shown in FIG. 2 has a sleeve-shaped configuration and is formed, for example, by a round or rectangular tube section 32, with in each case one ring disk 33, 34 being provided on those end sides of said tube section which are remote from one another, wherein the ring openings in these ring disks 33, 34 form the mutually aligned through-openings 13, 14.

In order to achieve effective sliding guidance of the magnetic armature 8 in the guide sleeve 15 and in order to convert as much electrical drive energy into mechanical work as possible which is available for the pump function, the guide sleeve 15, in particular in the region of its insulation sleeve 18, on the inner circumference side and/or the magnetic armature 8 on the outer circumference side can have a friction-reducing sliding layer. In this case, an embodiment is preferred in which the sliding layer is configured as a polymer layer, for example as a polytetrafluoroethylene or molybdenum disulfide layer.

LIST OF REFERENCE SYMBOLS

1 Positive displacement pump
2 Pump housing

3 Pump head
4 Drive housing
5 Intermediate plate
6 Pump space
7 Pump diaphragm
8 Magnetic armature
9 Coil
10 Magnetic return path element
11 (Upper) side of magnetic return path element
12 (Lower) side of magnetic return path element
13 (Upper) through-opening
14 (Lower) through-opening
15 Guide sleeve
16 Conducting sleeve
17 Stator
18 Insulator sleeve
19 Outer thread
20 Sleeve head (on conducting sleeve 16)
21 Working air gap
22 Compression spring
23 Ring flange
24 Diaphragm space
25 Tool intervention area
26 Inlet
27 Intake channel
28 Outlet
29 Pressure channel
30 Nonreturn valve (in intake channel 27)
31 Nonreturn valve (in pressure channel 29)
32 Tube section (as magnetic return path element according to FIG. 2)
33 (Upper) ring disk (of magnetic return path element according to FIG. 2)
34 (Lower) ring disk (of magnetic return path element according to FIG. 2)

The invention claimed is:

1. A positive displacement pump (1) comprising a pump head (3), in which (3) a pump space (6) is provided, a pump diaphragm (7) associated with the pump space (6), a reciprocating drive that is separated from the pump space (6) by the pump diaphragm, the reciprocating drive has a magnetic armature (8) which is guided movably in a longitudinal direction and acts on a flat side of the pump diaphragm (7) which is remote from the pump space (6), and the magnetic armature performs an intake stroke electromagnetically counter to a restoring force upon energizing a coil (9), the coil (9) interacts with a magnetic return path element (10), the magnetic armature (8) is guided movably in a guide sleeve (15) that passes through through openings (13, 14) provided in sides (11, 12) of the magnetic return path element (10) that are remote from one another, a section of the guide sleeve (15) that is formed by a conducting sleeve (16) passes through the through opening (13) closer to the pump space (6), and a section of the guide sleeve (15) that is formed by a stator (17) passes through the through opening (14) remote from the pump space (6), the conducting sleeve (16) and the stator (17), which are produced from magnetically conductive material, are magnetically isolated by a section of the guide sleeve (15) that is formed by an insulator sleeve (18) made of magnetically non conductive material, and the sections of the guide sleeve (15) that are formed by the conducting sleeve (16) and the stator (17) overlap the coil (9) at each end thereof, and the magnetic armature (8) is guided in the section of the guide sleeve (15) that is formed by the insulator sleeve (18).

2. The pump as claimed in claim 1, wherein the conducting sleeve (16), the insulator sleeve (18) and the stator (17) of the guide sleeve (15) are welded, adhesively bonded or connected to one another.

3. The pump as claimed in claim 1, wherein that section of the guide sleeve (15) that is formed by the conducting sleeve (16) encompasses the magnetic armature (8) with clearance.

4. The pump as claimed in claim 1, wherein a compression spring restoring force is provided by at least one compression spring (22) acting on the magnetic armature (8).

5. The pump as claimed in claim 4, wherein the at least one compression spring (22) is supported on the conducting sleeve (16).

6. The pump as claimed in claim 1, wherein the stator (17) limits the intake stroke of the magnetic armature (8) in the guide sleeve (15).

7. The pump as claimed in claim 1, wherein a stroke length of the at least one pump diaphragm (7) is adjustable, and the pump (1) has a pump housing (2), in which (2) the guide sleeve (15) is arranged adjustably in the longitudinal direction for adjustment of the stroke length.

8. The pump as claimed in claim 7, wherein the guide sleeve (15) bears an outer thread (19), which meshes with an inner thread fixed in position relative to the pump housing (2), at least in one section of an outer circumference of said guide sleeve.

9. The pump as claimed in claim 8, wherein the conducting sleeve (16) has a sleeve head (20) which is configured as a cross section expansion and which bears the outer thread (19), and the inner thread is provided on the pump housing (2).

10. The pump as claimed in claim 1, wherein a friction reducing sliding layer is provided on at least one of the guide sleeve (15), in a region of the insulator sleeve (18), has on an inner circumferential side, or the magnetic armature (8) on an outer circumferential side.

11. The pump as claimed in claim 10, wherein the sliding layer is a polymer layer.

12. The pump as claimed in claim 10, wherein the sliding layer is a polytetrafluoroethylene or molybdenum disulfide layer.

13. The pump as claimed in claim 1, wherein the magnetic return path element (10) is formed as a coil frame.

14. The pump as claimed in claim 1, wherein the magnetic return path element has a magnetically conductive section, which has the through openings (13, 14) for the guide sleeve (15) in the end sides (11, 12) of said magnetically conductive section which are remote from one another.

15. The pump as claimed in claim 14, wherein the magnetically conductive section of the magnetic return path element (10) is formed by a round or rectangular tube section (32), with one ring disk (33, 34) being provided on end sides of said tube section that are remote from one another, and ring openings in the ring disks (33, 34) form the mutually aligned through openings (13, 14).

16. The pump as claimed in claim 14, wherein the sections of the guide sleeve (15) that are formed by the conducting sleeve (16) and the stator (17) extend through the through openings (13, 14) for the guide sleeve (15) in the end sides (11, 12) of the magnetic return path element (10).

* * * * *